US010807356B2

(12) United States Patent
Dubuit

(10) Patent No.: US 10,807,356 B2
(45) Date of Patent: Oct. 20, 2020

(54) PRINTING MACHINE FOR PRINTING OBJECTS AND CORRESPONDING METHOD

(71) Applicant: MACHINES DUBUIT, Noisy le Grand (FR)

(72) Inventor: Jean-Louis Dubuit, Paris (FR)

(73) Assignee: MACHINES DUBUIT, Noisy le Grand (FR)

( * ) Notice: Subject to any disclaimer, the term of this patent is extended or adjusted under 35 U.S.C. 154(b) by 67 days.

(21) Appl. No.: 16/284,970

(22) Filed: Feb. 25, 2019

(65) Prior Publication Data

US 2019/0270299 A1 Sep. 5, 2019

(30) Foreign Application Priority Data

Mar. 5, 2018 (FR) ..... 18 51871

(51) Int. Cl.

| | |
|---|---|
| ***B41F 17/08*** | (2006.01) |
| ***B41J 3/407*** | (2006.01) |
| ***B41F 15/08*** | (2006.01) |
| ***B41F 17/10*** | (2006.01) |
| ***B41F 17/18*** | (2006.01) |
| *B41J 11/00* | (2006.01) |

(52) U.S. Cl.

CPC ..... *B41F 15/0872* (2013.01); *B41F 17/08* (2013.01); *B41F 17/10* (2013.01); *B41F 17/18* (2013.01); *B41J 3/4073* (2013.01); *B41F 15/0886* (2013.01); *B41J 11/002* (2013.01); *B41J 11/0015* (2013.01)

(58) Field of Classification Search

CPC ..... B41F 17/08; B41F 17/10; B41F 17/18; B41F 15/0872; B41F 15/0886; B41J 3/4073; B41J 11/002; B41J 11/0015

USPC ..... 101/35, 40.1, 41, 115

See application file for complete search history.

(56) References Cited

U.S. PATENT DOCUMENTS

2016/0236483 A1* 8/2016 Till ..... B41J 2/01
2019/0105925 A1* 4/2019 Dubuit ..... B41J 25/001

FOREIGN PATENT DOCUMENTS

DE 69903773 T2 8/2003
WO 20160140707 A1 9/2016

OTHER PUBLICATIONS

INPI Rapport de Recherche Préliminaire for French Patent Application No. 1851871, dated Oct. 29, 2018, 2 pp.

(Continued)

*Primary Examiner* — Leslie J Evanisko
(74) *Attorney, Agent, or Firm* — Soquel Group LLC

(57) ABSTRACT

A printing machine, including a frame, at least one printing station having at least one inkjet print head, a turret rotating about an axis of rotation, object carriers rotating on the turret about respective object carrier axes, the turret being movable between a plurality of positions, and a drive system driving one of the object carriers in rotation relative to the turret, the drive system including a first part mounted on the frame, and a second part having a locking device and a drive device, wherein the second part moves between an active position, in which the drive device rotates one of the object carriers and the locking device locks the rotating turret about the axis of rotation in one of the positions of the turret, and a rest position, in which the drive device and the locking device are away from the one of the object carriers.

11 Claims, 3 Drawing Sheets

(56) References Cited

OTHER PUBLICATIONS

INPI Opinion Écrite Sur la Brevetabilité de L'Invention for French Patent Application No. 1851871, dated Oct. 29, 2018, 3 pp.

* cited by examiner

PRINTING MACHINE FOR PRINTING OBJECTS AND CORRESPONDING METHOD

CROSS-REFERENCE TO RELATED APPLICATIONS

This application claims priority of French Patent Application No. 18 51871 filed on Mar. 5, 2018.

FIELD OF THE INVENTION

The present invention relates to printing machines.

BACKGROUND OF THE INVENTION

Printing stations, especially those with inkjet print heads, require very precise positioning of the object to be printed. In fact, the underside of the inkjet print heads includes rows of nozzles, wherein the nozzles are, for example, spaced apart from each other by 0.07105 mm in the same row. However, it has sometimes been found in machines of the type described above that the quality of the positioning of the objects with respect to the printing station is inadequate, which can lead to a decrease in the quality of the printing.

In addition, in these machines, each object carrier is associated with a rotating actuator, so that the object rotates below the printing station. Such machines, therefore, have a large number of actuators, which has a negative impact on the cost. In addition, each of these actuators must be set in order to obtain the desired movement of the object below the printing station. The settings are quite long and tedious.

There is thus a need to overcome all or some of the above disadvantages by providing a less expensive printing machine and/or allowing improved print quality.

BRIEF SUMMARY OF THE INVENTION

An object of the invention is, therefore, to overcome all or some of the above disadvantages by providing a less expensive printing machine and/or allowing improved print quality.

For this purpose, the present invention relates to a printing machine for printing a plurality of objects, wherein the printing machine includes:

- a frame,
- at least one printing station fixed on the frame, wherein the printing station includes at least one inkjet print head,
- a turret mounted to rotate relative to the frame about an axis of rotation,
- a plurality of object carriers designed to carry the objects, wherein the object carriers are mounted on the turret to rotate about respective object carrier axes, wherein the turret is movable between a plurality of positions with respect to the frame, and wherein at least one of the object carriers faces the printing station in each of the positions of the turret, and
- a drive system for rotating one of the objects with respect to the turret.

The drive system includes:

- at least a first part mounted on the frame, and
- at least a second part, wherein the second part includes a locking device and a drive device, wherein the second part is mounted to move relative to the first part between an active position, in which the drive device is designed to drive one of the object carriers in rotation, and the locking device is designed to lock the turret in rotation about the axis of rotation relative to the frame in one of the positions of the turret, and a rest position, in which the drive device is away from one of the object carriers, and the locking device is away from the turret.

According to particular embodiments, the printing machine includes one or more of the following features, taken in isolation or in any technically feasible combination:

- the locking device includes at least one finger, and the turret forms a plurality of notches, wherein one of the notches is designed to receive the finger in the active position, or the locking device forms at least one notch, while the turret includes a plurality of fingers, wherein the notch is designed to receive one of the fingers in the active position;
- each of the objects defines a drive track, wherein the drive device includes: a belt that is designed to be in contact with one of the drive tracks in the active position in order to drive one of the object carriers, the belt being away from one of the drive tracks in the rest position, and an actuator designed to move the belt;
- the second part of the drive system includes a plate, the drive device further including a toothed pulley designed to be driven by the actuator in rotation with respect to the plate, and at least two pulleys rotatably mounted on the plate to tension and guide the belt, wherein the two pulleys define an active segment of the belt between them, while the active segment is designed to bear against the drive track in the active position;
- the belt includes two opposite toothed faces;
- the second part is mounted to move in translation relative to the first part in a translation direction, while the drive system further includes an actuator that is designed to move the second part from the rest position into the active position, and vice versa;
- the actuator that is designed to move the second part includes at least one pneumatic or electrical jack;
- in each of the positions of the turret, one of the object carriers is situated in the vicinity of the drive device, wherein the object carrier axis of the one of the object carriers is substantially orthogonal to the direction of translation;
- the direction of translation is substantially parallel to the axis of rotation of the turret; and
- the frame includes a gantry, and a turret support on which the turret is mounted to rotate about the axis of rotation, wherein the turret support is adjustable in inclination about a tilting axis with respect to the gantry, and/or the frame includes a support for the drive system.

The invention also relates to an assembly of a printing machine as described above and the plurality of objects to be printed.

Finally, the invention relates to a printing method for printing a plurality of objects, wherein the method includes the following steps:

- providing a printing machine as described above,
- placing the objects on the object carriers,
- moving the turret between the plurality of positions relative to the frame, and
- moving the second part of the drive system from the rest position to the active position,
- driving of one of the objects in rotation with respect to the turret by the drive device, and locking of the turret in rotation about the axis of rotation relative to the frame in one of the positions of the turret by the locking device, and moving the second part from the active position to the rest position.

BRIEF DESCRIPTION OF THE SEVERAL VIEWS OF THE DRAWING(S)

The invention will be better understood upon reading the description which follows, given solely by way of example and with reference to the appended drawings, wherein.

DETAILED DESCRIPTION OF THE INVENTION

Figure 1:
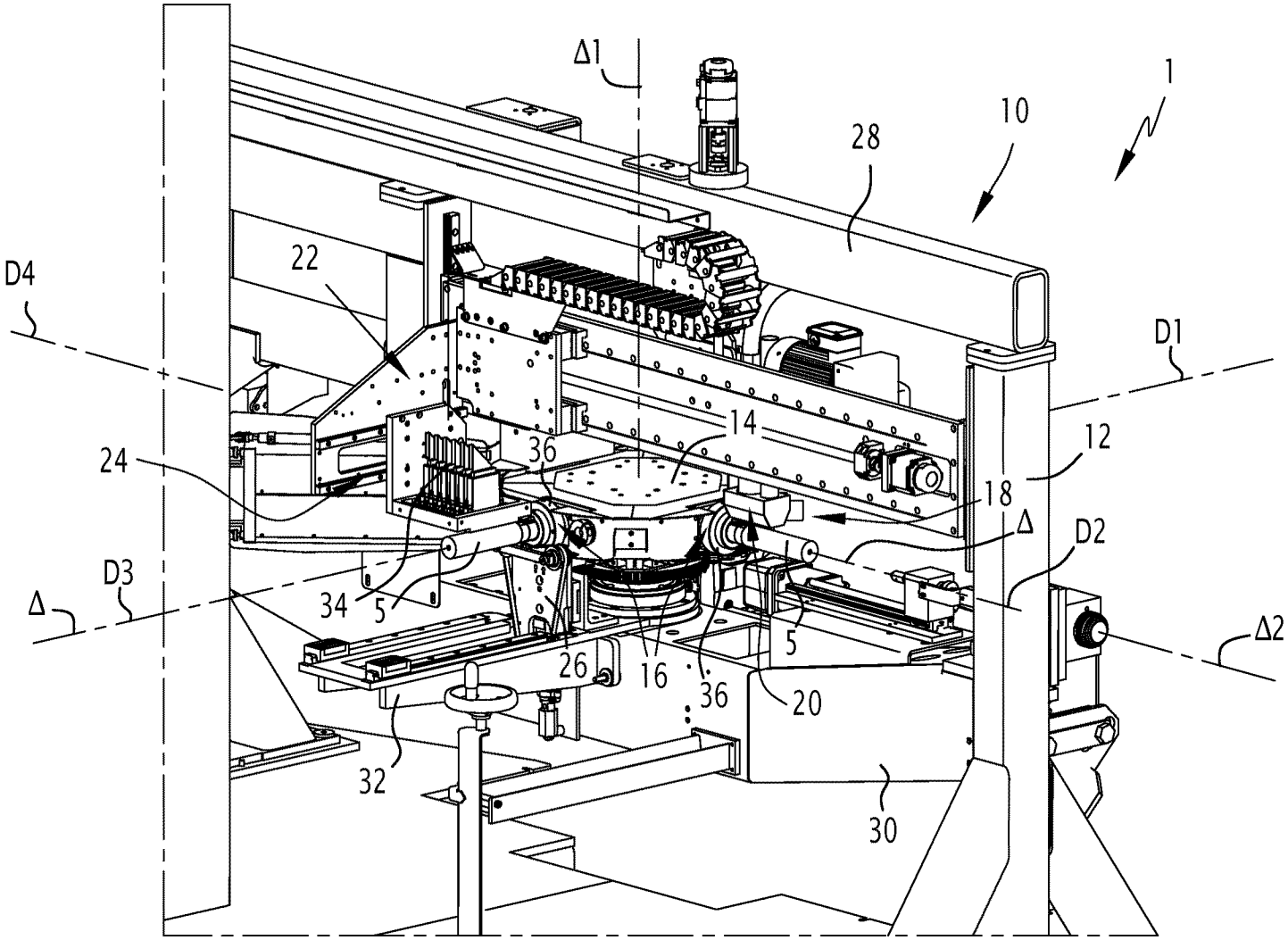
FIG. 1 shows a partial view, in perspective, of an assembly according to the invention.

An assembly 1 according to the invention is described with reference to FIG. 1.

The assembly 1 includes a plurality of objects 5 to be printed, and a printing machine 10 for printing the objects.

The objects 5 are analogous to each other. Each object 5 is, for example, substantially of revolution about an object axis Δ. Each object 5 is, for example, a tube, but may be a bottle, a beaker or a cup.

The objects 5, for example, have a cylindrical or frusto-conical outer surface.

The printing machine 10 includes a frame 12, a turret 14 that is rotatably mounted and indexed relative to the frame about an axis of rotation Δ1, and a plurality of object carriers 16 designed to carry the objects. The printing machine 10 further includes, in the example shown, a loading station 18, a pre-processing station 20, a printing station 22, and a post-processing station 24, wherein all of these stations are advantageously angularly distributed around the axis of rotation Δ1. Finally, the printing machine 10 includes a drive system 26 that is designed to drive one of the object carriers 16 in rotation with respect to the turret 14.

The frame 12 includes a gantry 28 on which the pre-processing station 20, the printing station 22 and the post-processing station 24 are fixed. In the example shown, the frame 12 also includes a turret support 30 mounted on the gantry 28 to rotate about an axis of inclination Δ2. Finally, the frame 12 includes a support 32 forming a seat on which the drive system 26 is mounted.

The gantry 28, for example, has an inverted "U" shape.

The turret support 30 advantageously forms a cradle located below the processing stations. The turret support 30 is designed to adjust the inclination of the turret 14 relative to the horizontal about the axis of inclination Δ2.

The support 32 is, for example, fixed on the support of the turret 30.

The pre-processing station 20 is designed, for example, to perform plasma pre-processing of the surface of the objects 5 to be printed.

The printing station 22, for example, includes print heads 34 that are designed to project ink jets onto one of the facing objects 5. The ink jets are, for example, vertical.

The print heads are, for example, of the piezoelectric type and can print a pattern (not shown) on the objects 5, for example using a four-color process.

The post-processing station 24 is advantageously designed to carry out the drying of the ink deposited on the objects 5, for example using UV (ultraviolet) rays.

The object carriers 16, four in number in the example, are respectively rotatably mounted on the turret 14 about the object carrying axes D1, D2, D3, D4. The object carriers 16 are regularly spaced at 90° about the axis of rotation Δ1 of the turret 14.

The turret 14 is rotatable about the axis of rotation Δ1 between a successive plurality of positions, four in number in the example, relative to the frame 12. In each of these positions of the turret 14, one of the object carriers 16 allows the loading or unloading of one of the objects 5, another of the object carriers 16 holds one of the objects 5 opposite the pre-processing station 20, another of the object carriers 16 holds one of the objects 5 opposite the printing station 22, and finally the last of the object carriers 16 holds one of the objects 5 at the post-processing station 24.

Each of the object carriers 16 further respectively defines a circular drive track 36 about the object carrier axes D1-D4. The object carrier axes D1-D4 respectively merge with the object axes A of the objects they carry.

In the example shown, the object carrier axes D1 to D4 are horizontal. The object carrier axes D2 and D4 are substantially coincidental and parallel to the axis of inclination Δ2. The object carrier axes D1 and D3 are substantially coincidental and perpendicular to the object carrier axes D2 and D4.

According to a variant not shown, the turret 14 has a different number of object carriers, for example two, six, eight or more.

In a particular embodiment the turret 14 and the object carriers 16 may be devoid of any system capable of rotating the objects 5 on themselves.

Figure 2:
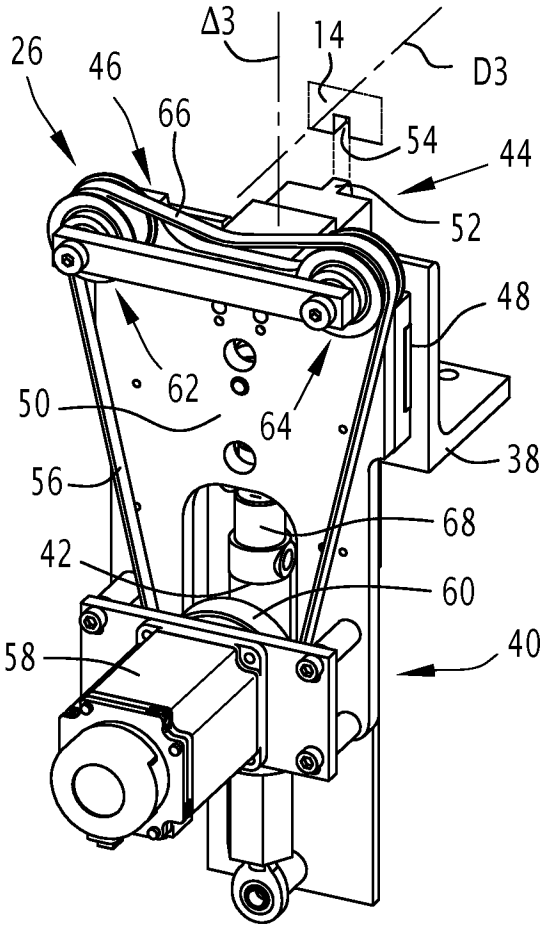
FIG. 2 shows a perspective view of the drive system shown in FIG. 1.
Figure 3:
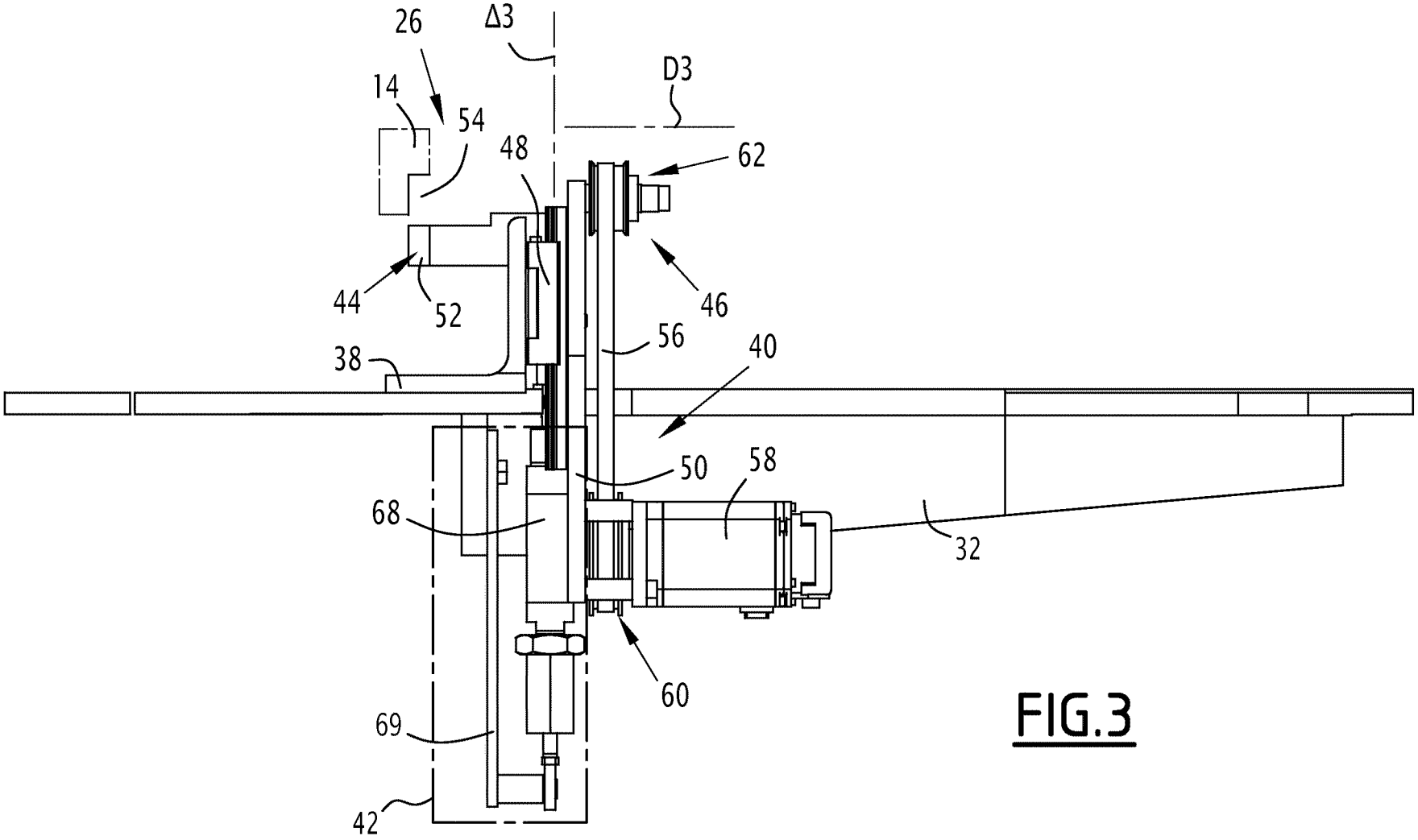
FIG. 3 shows a side view of the drive system shown in FIGS. 1 and 2.

As may be seen in FIGS. 2 and 3, the drive system 26 includes a first part 38 mounted on the support 32, and a second part 40 mounted to move in translation relative to the first part in a direction of translation Δ3 which is, in the example shown, substantially parallel to the axis of rotation Δ1 of the turret 14; i.e., vertical in FIGS. 1-3. The drive system 26 also includes an actuator 42 that is designed to move the second part 40 with respect to the first part 38 in the direction of translation Δ3.

The first part 38 is, for example, a square.

The second part 40 includes a locking device 44 and a drive device 46.

The second part 40 is movable between an active position, shown in FIGS. 1 and 2, and a rest position (not shown and which is deduced from the active position by the translation of the second part 40 downwards in FIG. 1).

In the active position, the drive device 46 is designed to rotate the object carrier 16 opposite the printing station 22, and the locking device 44 is designed to lock the turret 14 in rotation relative to the frame 12 in one of the previously mentioned positions of the turret.

In the rest position, the drive device 46 is away from the object carrier 16 in question, and the locking device 44 is also away from the turret 14.

The second part 40 is, for example, mounted on the first part 38 by slides 48.

The second part 40, for example, includes a plate 50 on which the locking device 44 and the drive device 46 are mounted.

In particular, the locking device 44 is not a device for rotating the turret 14.

Advantageously, the locking device 44 makes it possible to lock the turret 14 in its successive angular positions around the axis of rotation Δ1 with a positioning accuracy of the objects 5 under the print heads 34 that is greater than 0.1 mm in the circumferential direction about the axis of rotation Δ1.

In the example shown, the locking device 44 includes a finger 52 designed to be received in notches 54 of the turret 14 (one of which is shown in FIGS. 2 and 3) in the active position of the second part 40. The turret 14 then has four notches 54.

The notches 54 are here four in number and are advantageously evenly distributed on a lower face of the turret 14 about the axis of rotation Δ1.

According to a variant not shown, the locking device 44 forms a notch and the turret 14 has fingers, wherein the notch is designed to receive one of the fingers in the active position. In the example, there would therefore be four fingers corresponding to the four positions of the turret 14.

According to other variants not shown, the locking system takes other forms known in themselves to those skilled in the art.

The drive device 46 includes, in the example shown, a belt 56 that is designed to be in contact in the active position with the drive track 36 of the object carrier 16 located opposite the printing station 22, and to drive this object carrier. The drive device 46 also includes an actuator 58 to move the belt 56 by means of a pulley 60 that is advantageously toothed, and includes two pulleys 62, 64 that are rotatably mounted on the plate 50 in order to tension and guide the belt 56.

The pulley 60 is designed to be driven by the actuator 58 in rotation with respect to the plate 50.

The two pulleys 62, 64 define between them an active segment 66 (FIG. 2) of the belt 56, which is designed to bear against the drive track 36 of the object carrier 16 located opposite the printing station 22 and the second part 40 when in the active position.

The track 36 of the object carrier 16 is also advantageously toothed.

The actuator 42, for example, includes a connecting plate 39 fixed on the support 32, and a jack 68 fixed on the connecting plate and on the plate 50.

The jack 68 is, for example, pneumatic.

According to a variant not shown, the jack 68 is electric. It then includes a servomotor controlling a screw which translates a nut that is integral with the plate 50. This allows the print rate to be increased by advantageously combining the rotational movement of the turret 14 with the translational movement of the second part 40 along the axis Δ3.

The direction of translation Δ3 is advantageously substantially parallel to the axis of rotation Δ1 of the turret 14.

The active segment 66 shown in FIG. 2 has a concave shape because it is pressed against the drive track 36 in the active position (see FIG. 1).

Figure 4:
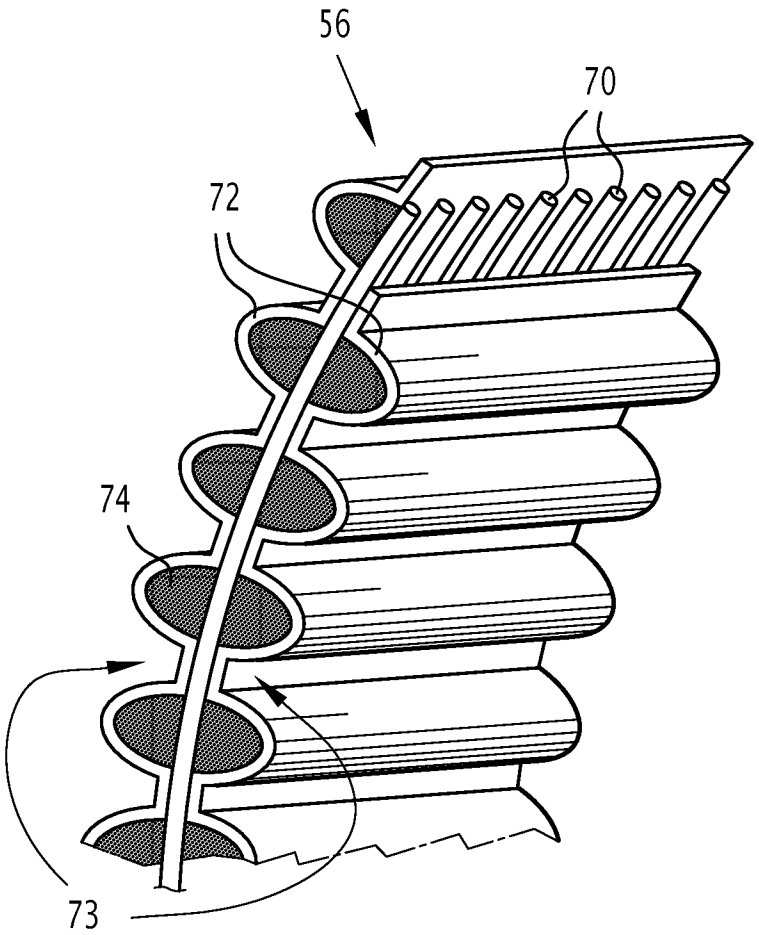
FIG. 4 shows a detailed view of the drive belt of the drive system shown in FIGS. 1-3.

As may be seen in FIG. 4, the belt 56 is advantageously a toothed belt, for example with a circular profile. The belt 56 includes a frame 70, for example made of fiberglass, two webs 72, for example made of polyamide, forming two opposite faces 73 of the belt, and a filling material 74, for example polychloroprene. The belt 56 is advantageously toothed on the two opposite faces 73. The internal toothing allows precise driving of the belt 56 by the actuator 58 and the pulley 60, while the external toothing allows precise driving of the object carrier 16 by the belt.

The operation of the assembly 1 is deduced from its structure and will now be described to illustrate a method according to the invention.

When the machine 10 is in operation, one of the objects already printed is removed from its carrier 16 at the loading station 18 shown in the background of FIG. 1. Another object 5, not yet printed, is placed on this object carrier 16.

The turret 14 is then moved to its next position by a rotation about the axis of rotation Δ1. This brings the newly-loaded object 5 to the pre-processing station 20, which pre-processes the object using plasma.

At the same time, another of the objects 5 is located below the printing station 22, and another object 5 is located at the post-processing station 24. Each of the movements of the turret 14 from one of its positions to the next position moves the loaded objects 5 from one processing station to the next station.

Before the arrival of one of the objects 5 below the printing station 22, the drive system 26 is in the rest position. There is then no rotational drive of the object carrier 16 in question, and the turret 14 is simply positioned relative to the processing stations.

When the concerned object carrier 16 arrives to face the printing station 22, the turret 14 is immobilized and the jack 68 passes the second part 40 from the rest position to the active position. During its movements, the plate 50 slides relative to the first part 38 in the direction of translation Δ3. In the example shown, the second part 40 rises relative to the frame 12.

This has a double effect. On the one hand, the locking device 44, which was away from the turret 14, approaches the turret and the finger 52 is received in one of the notches 54, in order to immobilize the turret in an angular position relative to the axis of rotation Δ1 that is perfect for obtaining good printing on the object 5 located facing the printing station 22.

On the other hand, this passage to the active position brings the active segment 66 of the belt 56 into contact with the drive track 36 of the object carrier 16 located opposite the printing station 22. The movement of the belt 56 obtained by means of the actuator 58 then drives the object carrier 16 in rotation about the object carrier axis D3. This has the effect of rotating the object 5 about its object carrier axis Δ.

The movements of the belt 56 are controlled very accurately by the actuator 58. Advantageously, the toothed structure of the belt 56 described above allows very precise transmission of the movements of the belt 56 to the object carrier 16 by meshing. The rotation of the object 5 below the print heads 34 is thus very precisely controlled.

When printing is complete, the second part 40 is returned to the rest position by the jack 68. The belt 56 is then no longer in contact with the drive track 36. The finger 52 of the locking device 44 comes out of the notch 54 and the turret 14 is again free to rotate.

The turret 14 then moves to the next angular position. The object 5 that has just been printed then arrives at the level of the post-processing station 24.

The above steps are repeated cyclically, so that each of the objects 5 is successively loaded, pre-processed, then printed, post-processed, and finally unloaded.

Depending on the shape of the object 5, it is possible to tilt the turret 14 relative to the inclination axis Δ2 so that an upper generatrix of the surface of the objects 5 to be printed is advantageously substantially horizontal at the printing station 22.

With the features described above, the printing machine 10 is less expensive and allows for improved print quality.

In particular, thanks to the locking device 44, the turret 14 is very precisely immobilized in the desired angular positions with respect to the axis of rotation Δ1. The locking device 44 makes it possible to position the object very precisely below the printing station 22. In addition, there is only one rotary drive device and it is capable of acting on any of the object carriers 16 as soon as the object carrier is opposite the printing station 22. In addition, the same actuator 42 makes it possible to obtain both precise angular locking of the turret 14 and the activation of the drive device 46.

The invention claimed is:

1. A printing machine for printing a plurality of objects, comprising:

a frame;

a printing station fixed on said frame, comprising at least one inkjet print head;

a turret rotating relative to said frame about an axis of rotation;

a plurality of object carriers mounted on said turret, carrying the objects, and rotating about respective object carrier axes, wherein said turret is movable between a plurality of positions relative to said frame, and wherein at least one of said object carriers is opposite said printing station in each of the positions of said turret; and a drive system for driving one of said object carriers in rotation with respect to said turret, comprising:

a first part mounted on said frame; and a second part, comprising:

a locking device; and a drive device, wherein the second part moves relative to said first part between an active position, in which the drive device rotates one of said object carriers, and said locking device locks said turret in rotation relative to said frame about the axis of rotation in one of the positions of said turret, and a rest position, in which the drive device is away from the one of said object carriers and said locking device is away from said turret.

2. The printing machine according to claim 1, wherein:

said locking device comprises at least one finger, and said turret forms a plurality of notches, wherein one of the notches receives said finger in the active position; or said locking device forms at least one notch, and said turret comprises a plurality of fingers, wherein the notch is designed to receive one of said fingers in the active position.

3. The printing machine according to claim 1, wherein each of said object carriers defines a drive track, and said drive device comprises:

a belt in contact with one of the drive tracks in the active position to drive one of said object carriers, the belt being away from the one of the drive tracks in the rest position; and an actuator moving said belt.

4. The printing machine according to claim 3, wherein said second part of said drive system comprises a plate, and wherein said drive device further comprises:

a toothed pulley driven by said actuator in rotation relative to said plate; and at least two pulleys rotatably mounted on said plate to tension and guide said belt, wherein the two pulleys define between them an active segment of said belt that bears against the drive track in the active position.

5. The printing machine according to claim 3, wherein said belt comprises two opposite toothed faces.

6. The printing machine according to claim 1, wherein said second part is movably mounted in translation relative to said first part in a direction of translation, and wherein said drive system further comprises an actuator that moves said second part from the rest position to the active position, and vice versa.

7. The printing machine according to claim 6, wherein said actuator comprises at least one pneumatic or electrical jack.

8. The printing machine according to claim 6, wherein, in each of the positions of said turret, one of said object carriers is located in the vicinity of said drive device, the object carrier axis of the one of said object carriers being orthogonal to the direction of translation.

9. The printing machine according to claim 6, wherein the direction of translation is parallel to the axis of rotation of said turret.

10. The printing machine according to claim 1, wherein said frame comprises:

a gantry; and a turret support on which said turret is mounted and rotates about the axis of rotation, wherein the turret support is adjustable in inclination with respect to said gantry about a tilting axis;

and/or said frame comprises a support of said drive system.

11. A printing method for printing a plurality of objects, comprising:

providing a printing machine according to claim 1;

placing the objects on the object carriers;

moving the turret between the plurality of positions relative to the frame;

moving the second part of the drive system from the rest position to the active position;

rotating one of the object carriers with respect to the turret by the drive device, and locking the turret in rotation about the axis of rotation relative to the frame in one of the positions of the turret by the locking device; and moving the second part from the active position to the rest position.

* * * * *